United States Patent [19]

Nishida et al.

[11] Patent Number: 4,981,380

[45] Date of Patent: Jan. 1, 1991

[54] PRINTER WITH MECHANISM FOR GUIDING PAPER

[75] Inventors: Kojiro Nishida; Kazumi Hasegawa, both of Tokyo, Japan

[73] Assignee: Citizen Watch Co., Ltd., Tokyo, Japan

[21] Appl. No.: 491,425

[22] Filed: Mar. 9, 1990

[30] Foreign Application Priority Data

Mar. 10, 1989 [JP] Japan ..... 1-26679

[51] Int. Cl.[5] ..... B41J 11/26

[52] U.S. Cl. ..... 400/619; 400/616.2; 226/198

[58] Field of Search ..... 400/616, 616.1, 616.2, 400/619, 611, 613-613.4; 226/196, 198, 199

[56] References Cited

U.S. PATENT DOCUMENTS

| | | | |
|---|---|---|---|
| 3,107,836 | 10/1963 | Van't Veld | 400/619 |
| 4,226,410 | 10/1980 | McIntosh, Sr. | 226/198 |
| 4,729,681 | 3/1988 | Moser | 400/613.2 |

FOREIGN PATENT DOCUMENTS

| | | | |
|---|---|---|---|
| 2912883 | 10/1980 | Fed. Rep. of Germany | 400/619 |
| 0064777 | 3/1988 | Japan | 400/616.2 |

OTHER PUBLICATIONS

"Printer Continuous Forms Guide" IBM Technical Disclosure Bulletin, vol. 22, No. 10, Mar. 1980, p. 4361.

*Primary Examiner*—Eugene H. Eickholt

*Attorney, Agent, or Firm*—Wenderoth, Lind & Ponack

[57] ABSTRACT

A printer with a mechanism for guiding paper has a lower casing having a printer body therein with a print head therein, an upper casing hingedly mounted on the lower casing for movement between a closed and an open position relative to the printer body, and the lower casing has a lower casing guide member and the upper casing having an upper casing guide member which is in spaced opposed relation to the lower casing guide member when the upper casing is in the closed position for defining between the guide members a paper guide path. The lower casing has a paper feeding opening for feeding a printing paper into the printer past the print head and over the lower casing guide member. The upper casing guide member is pivotally mounted on the upper casing for pivoting movement of the part of the upper casing guide member which is toward the paper feeding opening toward and away from the lower casing guide member. A spring is engaged with the upper casing guide member normally urging the upper casing guide member in a pivoting direction in which the part of the upper casing guide member which is toward the paper feeding opening is moved away from the lower casing guide member. A cam on the lower casing and the upper casing guide member, when the upper casing is moved from the open position to the closed position, pivots the upper casing guide member against the action of the spring to a position, when the upper casing is in the closed position, in which it is in the spaced opposed relation to the lower casing guide member for defining the paper guide path.

4 Claims, 5 Drawing Sheets

PRINTER WITH MECHANISM FOR GUIDING PAPER

The present invention relates to a mechanism for guiding paper past a printer and in which a guide path for feeding paper past the printer is formed by upper and lower casings.

BACKGROUND OF THE INVENTION

A conventional paper guiding mechanism for a printer is shown in Japanese Laid-Open Utility Model Application No. Sho 59-67255.

The mechanism as disclosed has a lower casing having a lower guide in which a printer body having a print head and paper feeding tractors are mounted, and an upper casing having an upper guide which is connected to the lower casing by a connecting means such as hinges. When the upper casing is closed against the lower casing, a paper guide path for guiding paper past the printer is formed between the upper guide of the upper casing and lower guide of the lower casing. The paper is supplied to the lower casing through a supply gate which is formed in a bottom surface of the lower casing, is engaged with paper feeding tractors positioned along the paper guide path, and is discharged from a discharge port which is formed in the rear surface after being fed along the guide path.

In such a conventional paper guide mechanism as described above, the upper casing forming the upper side of the paper guide path is mounted so as to be able to be opened and closed relative to the lower casing containing the printer body forming the lower side of the paper guide path.

At the start of operation, paper is inserted into the printer body while the upper casing is opened, and the paper guide path is formed only when the upper casing is closed.

Therefore, the upper side of the paper guide path which is formed by the upper casing has to be shaped for guiding the leading end of the paper along the paper guide path when the upper casing is closed and to avoid causing a paper jam due to folded paper at the time of closing the upper casing.

However, because the upper side of the paper guide path is formed integrally with the upper casing, these two functions are inadequately carried out.

For example, in a conventional paper guide mechanism as shown in FIGS. 4(*a*)–4(*d*), when the upper casing 2 is closed when the paper 1 to be fed past the printer body projects upwardly above the lower side of the paper guide path, as shown in FIG. 4(*a*), the leading end of the paper is folded back in the direction opposite to the paper feeding direction as shown in FIG. 4(*b*), because the angle of the paper 1 to the upper side of the paper guide path is unsuitable.

Although the paper 1 may sometimes be guided in the proper direction and caused to enter the paper guide path when the operation of the printer starts, if the paper is thin or limp, it may be wrinkled up due to the folding back and the paper guide path clogs, as shown in FIG. 4(*c*). This is because the angle of the upper side of the paper guide path is unsuitable and the dimension of the path in the thickness direction of the paper is too large.

In order to overcome such defects, the shape of the upper side of the paper guide path can be formed as shown in FIG. 4(*d*) for reducing the dimension of the said thickness direction when the upper casing 2 is closed. However, when this is done, it often happens that the leading edge of the paper 1 does not enter the paper guide path properly when the upper casing 2 is closed.

OBJECTS AND BRIEF SUMMARY OF THE INVENTION

It is an object of the present invention to provide a paper guiding mechanism for a printer which overcomes the drawbacks of the conventional mechanism as described above.

Another object of the present invention is to prevent clogging of the guide path when the paper is fed while the upper casing is closed.

These objects are achieved according to the invention by guiding the leading end of the paper to a proper position which is not off the paper guide path when the upper casing is closed when the paper is initially fed.

These objects are achieved, according to the invention, by the provision of a printer with a mechanism for guiding paper, comprising: a lower casing having a printer body therein with a print head therein and having a lower casing guide member and cam portion; an upper casing hingedly mounted on said lower casing for movement between a closed and an open position relative to said printer body and having an upper casing guide member which is in spaced opposed relation to said lower casing guide member when said upper casing is in the closed position for defining between said guide members a paper guide path; a paper feeding means for feeding a printing paper into said printer past said print head and over said lower casing guide member; said upper casing guide member being pivotally mounted on said upper casing for pivoting movement of the part of said upper casing guide member which is toward said paper feeding means toward and away from said lower casing guide member; spring means engaged with said upper casing guide member normally urging said upper casing guide member in a pivoting direction in which said part of said upper casing guide member which is toward said paper feeding means is moved away from said lower casing guide member; and said cam portion on said lower casing and said upper casing guide member cooperating for, when said upper casing is moved from the open position to the closed position, pivoting said upper casing guide member against the action of said spring means to a position, when said upper casing is in the closed position, in which it is in said spaced opposed relation to said lower casing guide member for defining said paper guide path.

BRIEF DESCRIPTION OF THE DRAWINGS

The invention will be clear from the following detailed description taken together with the accompanying drawings, in which.

DETAILED DESCRIPTION OF THE INVENTION

Figure 1:
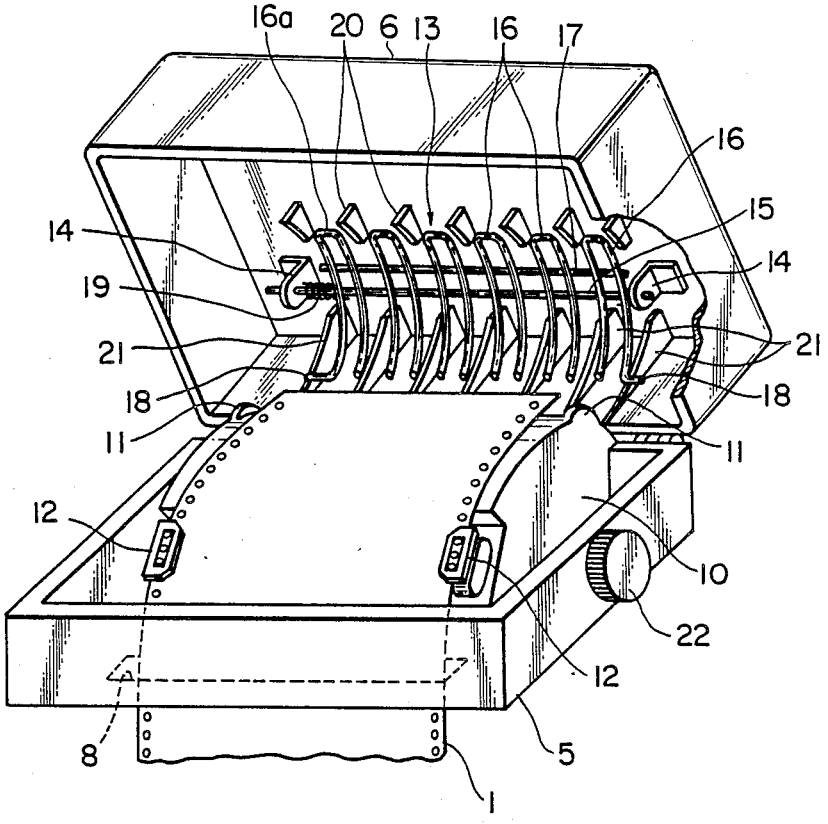
FIG. 1 is a perspective view of an embodiment of a printer with a feed mechanism according to the present invention.

An embodiment of the present invention will be described with reference to FIGS. 1–3(*c*).

A printer has a lower casing 5 in which a printer body 10 is mounted.

Figure 3A:
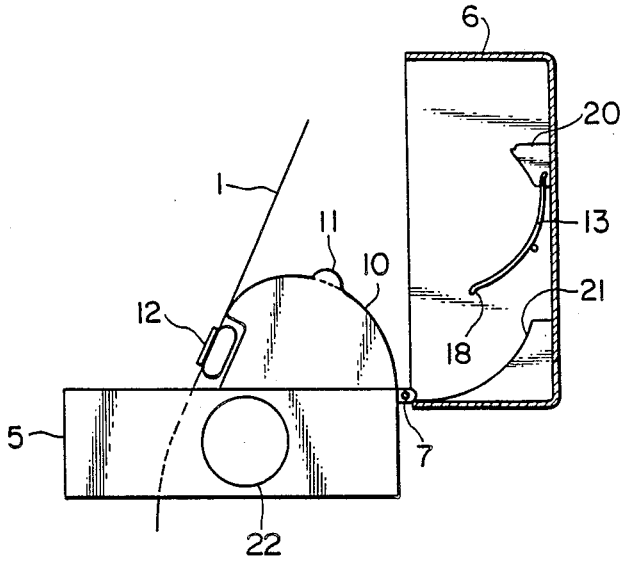
FIGS. 3(*a*)–3(*d*) are schematic sectional side views showing the feeding of paper into the printer having the feed mechanism according to the present invention.
Figure 3B:
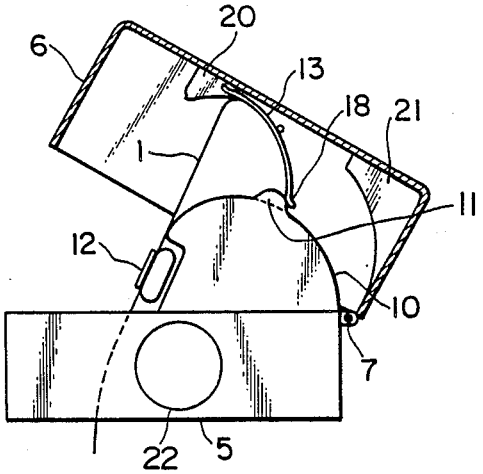
Figure 3C:
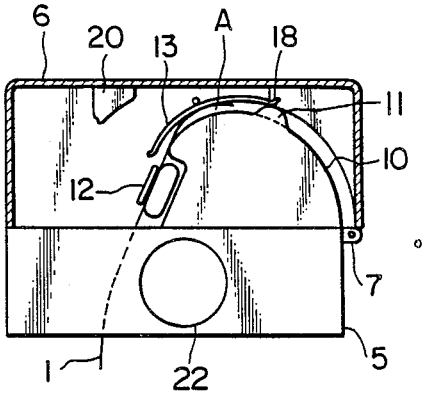
Figure 4A:
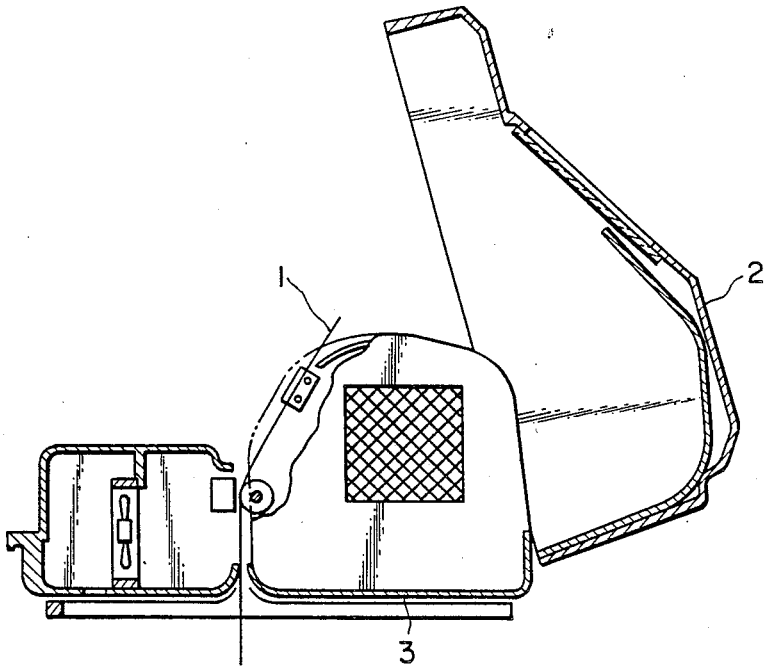
FIGS. 4(*a*)–4(*d*) are schematic sectional side views for showing the feeding of paper into a conventional printer.
Figure 4B:
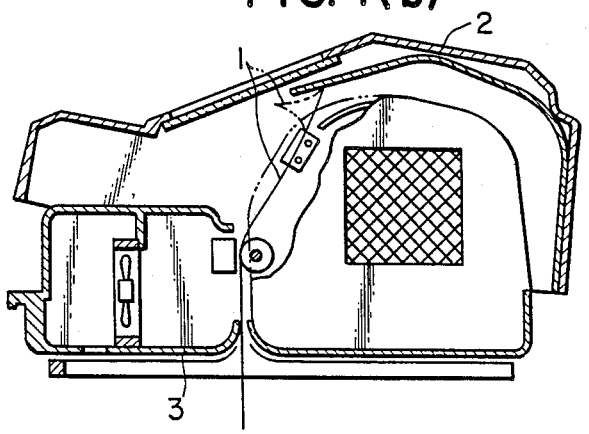
Figure 4C:
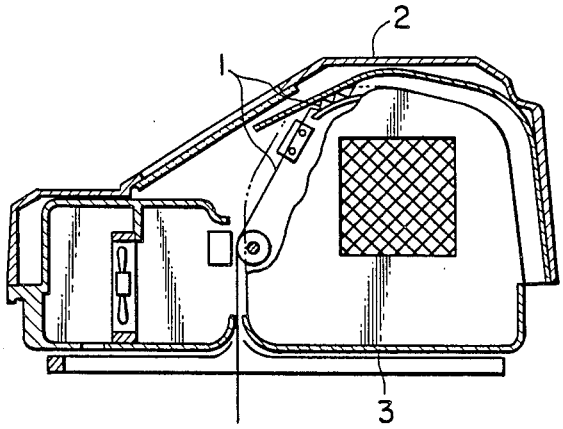
Figure 4D:
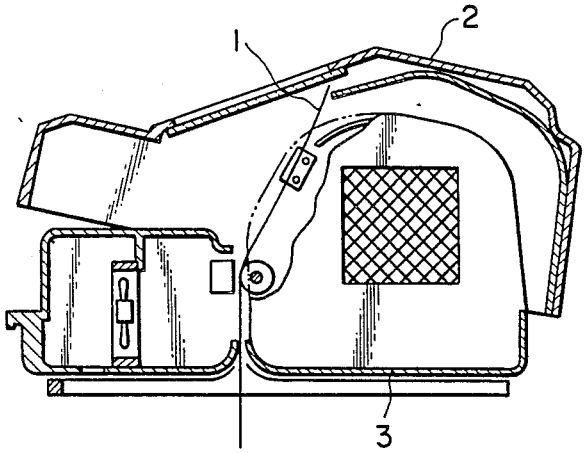

An upper casing 6 is hingedly mounted on the lower casing 5 by a pair of hinges 7 so that the upper casing 6 can be opened and closed freely between the positions as shown in FIGS. 3(*a*) and 3(*c*).

The casings 5 and 6 have guide members therein defining between them a paper guide path A for guiding the paper 1 past the printer body 10. At the front end of the paper guide path A is a feeding opening 8 which is formed in the front portion of the bottom of the lower casing 5. The guide member of the lower casing 5 is the curved upper surface of the printer body 10. This surface is semicylindrical and it is wider than the paper 1. Guide member 13 of the upper casing is described more fully hereinafter.

The paper 1 enters the lower casing 5 through the feeding opening 8 and is discharged from the lower casing 5 through a discharge opening 9 between the hinges 7.

Cam means in the form of a semicircular cam portion 11 is provided on the printer body 10 on each side of the path A part way toward the discharge opening 9.

A paper feeding tractor 12 is mounted on the printer body 10 on each side of the paper guide path A. The paper 1 is engaged by pins of the tractor 12, and the paper is fed by movement of the tractors 12 along the path A by means (not shown) to pass a print head thereon (not shown) and to then be discharged from the discharge opening 9.

The guide member 13 consists of the shaft 15, plural pairs of curved guiding bars 16 joined at one end and which are spaced along and mounted on the shaft 15 extending across the path A, and a supporting bar 17 for supporting the guiding bars 16. Both ends of the guide member 13 are pivotally mounted on the inside of the upper casing 6 by means of two brackets 14 for swinging movement in the paper feed direction.

Each guiding bar 16 is curved so as to correspond to the shape of the curved upper surface of the printer body 10. The paper guide path A is defined by a clearance between the guide member 13 and printer body 10 when the upper casing 6 is in the closed position as shown in FIGS. 2 and 3(*c*).

Guiding bars 16a are located at each end of the shaft 15. The part of each guiding bar 16*a* which is toward the discharge opening 9 when the upper casing is closed has cam engaging means in the form of a contact portion 18 thereon projecting laterally for contacting the cams 11 when the upper casing 6 is closed.

Spring means in the form of a coil spring 19 is mounted between a bracket 14 and guide member 13 for normally urging the part of the guide member 13 which is toward the feed opening 8 in a direction away from the path A. One end of the spring 19 is engaged with the bracket 14 and another end is engaged with one end of the guiding bar 16*a*.

Fixed guide members in the form of a plurality of feed guide ribs 20 and a plurality of discharge guide ribs are mounted on the inside of the upper casing 6. A rib 20 and a rib 21 are mounted between each pair of guiding bars 16 and a rib 20 and a rib 21 are mounted laterally outwardly of the respective end guiding bars 16a. The feed guide ribs 20 extend toward the feed opening 8 from between the guiding bars 16 and the discharge guide ribs 21 extend toward the discharge opening 9 from between the guiding bars. The ribs 20 and 21 have lower free edges which are curved along a line which is a continuation of the shape of the guiding bars 16 and define a part of the paper guide path A.

A knob 22 is provided for moving the tractor 12 manually.

The operation of the mechanism of the present invention will now be described.

The paper 1 is set. With the upper casing 6 open as shown in FIG. 3(*a*), paper 1 is fed through the feeding opening 8 from the bottom of lower casing 5, engaging with the tractors 12 and with the leading end projecting a desired length past the tractors and generally tangentially to the upper surface of the printer body 10 by rotating the knob 22. At this time, the contact portions 18 of the guide member 13 are disengaged from the cams 11 on the printer body 10. Therefore, the part of the guide member 13 which is toward the feed opening is pivoted toward the inside of the top of the upper casing 6 by the coil spring 19.

As the side of the guide member 13 toward the feed opening is opened widely, a paper introducing portion having a large radius of curvature is formed by the guide member 13 and the feed guide ribs 20.

When the upper casing 6 is closed, even though the leading end of the paper 1 projects well past the tractors 12 and is separated from the upper surface of the printer body 10 when the paper is set as shown in FIG. 3(*a*), the free end of the paper 1 engages the moving lower free edges of feed guide ribs 20 and is guided onto the guide member 13 surely, as shown in FIG. 3(*b*).

Figure 2:
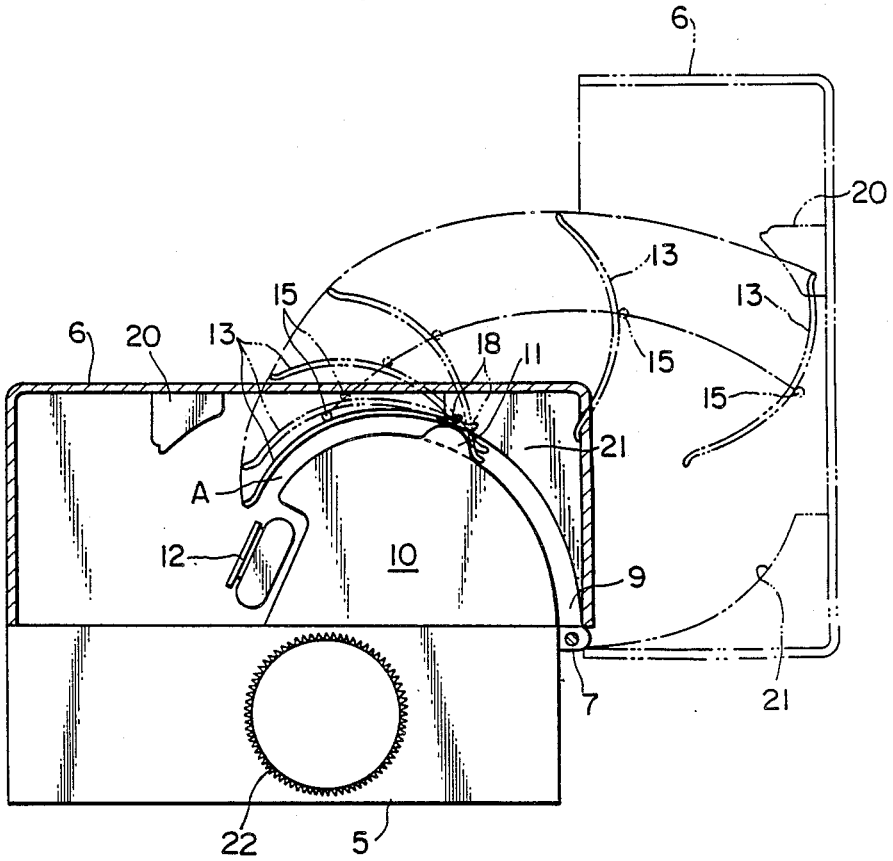
FIG. 2 is a schematic sectional side view of the printer of FIG. 1 showing movement of the guide member and the upper casing.

The contact portions 18 on the ends of the guide member 13 contact the cam portions 11 on the printer body 10 during closing of the upper casing 6, and the guide member 13 is pivoted by the contact between the contact portion 18 and the cam portion 11 against the force of the coil spring 19 as shown by the chain line representations of the guide member 13 in FIG. 2.

When the upper casing 6 reaches the closed position, the guide member 13 has been moved by the cam action to a position to form the paper guide path A having a small thickness between the guide member 13 and the upper surface of the printer body 10.

Since the print paper 1 will then be guided into this small thickness paper guide path A, the feeding direction of the print paper 1 can be controlled securely.

Therefore, it is possible to prevent paper jams from occurring.

Because the cam surface of the cam portions 11 in the above-described embodiment is formed in an arched shape, the position of the guide member 13 is varied smoothly.

In the above embodiment, the guide member 13 is constructed of a plurality of guiding bars 16 having a curved shape. However, it may be formed as an integral member by molding of synthetic resin.

Instead of the coil spring 19, other spring means, such as a leaf spring, may be used.

As described above, the angle of the feed guide ribs during the closing of the upper casing is designed to guide the end of the paper smoothly into the paper guide path. When the upper casing is closed, it forms the most suitable clearance so that the paper does not fold in the paper guide path. Therefore, although the leading end of the paper projects too far from the tractors, the free end will still be guided smoothly into the paper guide path. Then the paper can be fed in the paper guide path smoothly in the feeding direction.

As a result, paper jams during feeding of the paper can be prevented.

What is claimed:

1. A printer with a mechanism for guiding paper, comprising:

a lower casing having a printer body therein with a print head therein and having a lower casing guide member and cam portion;

an upper casing hingedly mounted on said lower casing for movement between a closed and an open position relative to said printer body and having an upper casing guide member which is in spaced opposed relation to said lower casing guide member when said upper casing is in the closed position for defining between said guide members a paper guide path;

a paper feeding means for feeding a printing paper into said printer past said print head and over said lower casing guide member;

said upper casing guide member being pivotally mounted on said upper casing for pivoting movement of the part of said upper casing guide member which is toward said paper feeding means toward and away from said lower casing guide member;

spring means engaged with said upper casing guide member normally urging said upper casing guide member in a pivoting direction in which said part of said upper casing guide member which is toward said paper feeding means is moved away from said lower casing guide member; and said cam portion on said lower casing and said upper casing guide member cooperating for, when said upper casing is moved from the open position to the closed position, pivoting said upper casing guide member against the action of said spring means to a position, when said upper casing is in the closed position, in which it is in said spaced opposed relation to said lower casing guide member for defining said paper guide path.

2. A printer as claimed in claim 1 in which said lower casing guide member is constituted by an upper surface of said printer body.

3. A printer as claimed in claim 1 further comprising fixed feed guide members on said upper casing having portions thereon which, when said upper casing guide member is in the pivoted position with the part which is toward said paper feeding means away from said lower casing guide member, are extensions of the surface of said upper casing guide member which is opposed to said lower casing guide member.

4. A printer as claimed in claim 3 in which said lower casing guide member has a convexly curved surface, and said upper casing guide member is comprised of a plurality of spaced members extending in the direction of paper feed and curved concavely with a curvature to form a paper guide path when in spaced opposed relation to said lower casing guide member, and said fixed feed guide members comprise a plurality of fixed feed guide ribs, one between each of said spaced members and extending past the part of said upper casing guide member which is toward said paper feeding means and having lower free edges which are curved along a line which is a continuation of the shape of said spaced members.

* * * * *